US007206543B2

(12) United States Patent
Terao et al.

(10) Patent No.: US 7,206,543 B2
(45) Date of Patent: Apr. 17, 2007

(54) SHEET POST-PROCESS APPARATUS AND WAITING TRAY

(75) Inventors: Yasunobu Terao, Tagata-gun (JP); Yoshiaki Sugizaki, Sunto-gun (JP); Mikio Yamamoto, Tagata-gun (JP); Tomomi Iijima, Mishima (JP); Hiroyuki Taki, Tagata-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 77 days.

(21) Appl. No.: 11/008,147

(22) Filed: Dec. 10, 2004

(65) Prior Publication Data

US 2006/0067765 A1 Mar. 30, 2006

(30) Foreign Application Priority Data

Sep. 28, 2004 (JP) ..... 2004-282213

(51) Int. Cl.
*G03G 15/00* (2006.01)

(52) U.S. Cl. ..... 399/405; 399/397

(58) Field of Classification Search ..... 399/405, 399/407, 408, 410; 270/58.07–58
See application file for complete search history.

(56) References Cited

U.S. PATENT DOCUMENTS

| | | | |
|---|---|---|---|
| 4,473,425 | A | 9/1984 | Baughman et al. |
| 4,611,741 | A | 9/1986 | Wilson |
| 4,794,859 | A | 1/1989 | Huseby et al. |
| 4,849,796 | A | 7/1989 | Murakami |
| 4,898,374 | A | 2/1990 | Vermaat |
| 5,021,837 | A | 6/1991 | Uto et al. |
| 5,098,074 | A | 3/1992 | Mandel et al. |
| 5,282,611 | A | 2/1994 | Ueda et al. |
| 5,285,249 | A | 2/1994 | Mahoney |
| 5,289,251 | A | 2/1994 | Mandel et al. |
| 5,435,544 | A | 7/1995 | Mandel |
| 5,451,037 | A | 9/1995 | Lundstrom |

(Continued)

FOREIGN PATENT DOCUMENTS

JP 62-008965 A 1/1987

(Continued)

OTHER PUBLICATIONS

U.S. Appl. No. 11/085,226, filed Mar. 22, 2005, Terao et al.

(Continued)

*Primary Examiner*—Anthony H. Nguyen
(74) *Attorney, Agent, or Firm*—Foley & Lardner LLP

(57) ABSTRACT

A waiting tray comprises a waiting tray roller which ejects a transported sheet to a storage tray, a waiting tray roller drive source which drives the waiting tray roller so as to come into contact with the sheet or so as to be spaced from the sheet, and a waiting tray roller drive motor which rotates the waiting tray roller in a direction in which the sheet is to be ejected. In the case where the sheet is ejected from the waiting tray directly to the storage tray without intervening a processing tray, the waiting tray roller is driven by the waiting tray roller drive source and the waiting tray roller drive motor. In this manner, the sheet held on the waiting tray is directly held on a storage tray without being held on a processing tray.

4 Claims, 12 Drawing Sheets

U.S. PATENT DOCUMENTS

| | | | |
|---|---|---|---|
| 5,590,871 | A | 1/1997 | Okabe et al. |
| 5,628,502 | A | 5/1997 | Amarakoon |
| 5,676,517 | A | 10/1997 | Lotz |
| 5,709,376 | A | 1/1998 | Ushirogata |
| 5,934,140 | A | 8/1999 | Jackson et al. |
| 5,961,274 | A | 10/1999 | Bors |
| 5,971,384 | A | 10/1999 | Asao |
| 6,065,747 | A | 5/2000 | Khovaylo et al. |
| 6,092,948 | A | 7/2000 | Altfather |
| 6,142,461 | A | 11/2000 | Asao et al. |
| 6,179,287 | B1 | 1/2001 | Watanabe et al. |
| 6,231,039 | B1 | 5/2001 | Chung |
| 6,330,999 | B2 | 12/2001 | Coombs et al. |
| 6,336,630 | B1 | 1/2002 | Holtman et al. |
| 6,354,059 | B1 | 3/2002 | Yoshie et al. |
| 6,357,753 | B1 | 3/2002 | Yamasaki et al. |
| 6,450,934 | B1 | 9/2002 | Coombs |
| 6,581,922 | B2 | 6/2003 | Kuwata et al. |
| 6,641,129 | B2 | 11/2003 | Ogita et al. |
| 6,659,455 | B2 | 12/2003 | Endo et al. |
| 6,671,492 | B2 | 12/2003 | Mimura et al. |
| 6,698,744 | B2 | 3/2004 | Yamada et al. |
| 6,712,349 | B2 | 3/2004 | Watanabe |
| 6,722,646 | B2 | 4/2004 | Sekiyama et al. |
| 6,722,650 | B1 | 4/2004 | Abbata et al. |
| 6,733,006 | B2 | 5/2004 | Kobayashi et al. |
| 6,733,007 | B2 | 5/2004 | Sekiyama et al. |
| 6,767,012 | B2 | 7/2004 | Sasamoto |
| 6,819,906 | B1 | 11/2004 | Herrmann et al. |
| 6,824,128 | B2 | 11/2004 | Nagata et al. |
| 6,871,042 | B2 | 3/2005 | Nemura et al. |
| 6,910,686 | B2 | 6/2005 | Awano |
| 6,928,259 | B2 | 8/2005 | Sakuma |
| 6,988,728 | B2 | 1/2006 | Kida |
| 2002/0047233 | A1 | 4/2002 | Coombs et al. |
| 2002/0053766 | A1 | 5/2002 | Kubota |
| 2002/0163119 | A1 | 11/2002 | Kawata |
| 2003/0057625 | A1 | 3/2003 | Kuwata et al. |
| 2004/0113348 | A1 | 6/2004 | Awano |
| 2004/0126163 | A1 | 7/2004 | Asami et al. |
| 2004/0181308 | A1 | 9/2004 | Hayashi et al. |
| 2005/0000336 | A1 | 1/2005 | Hattori et al. |

FOREIGN PATENT DOCUMENTS

| | | | |
|---|---|---|---|
| JP | 04-312894 | A | 11/1992 |
| JP | 6-083132 | A | 3/1994 |
| JP | 2583594 | B2 | 11/1996 |
| JP | 2001-089009 | A | 4/2001 |
| JP | 2003-081517 | A | 3/2003 |

OTHER PUBLICATIONS

U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
U.S. Appl. No. 11/008,122, filed Dec. 10, 2004, Sasahara.
U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.

SHEET POST-PROCESS APPARATUS AND WAITING TRAY

CROSS-REFERENCE TO RELATED APPLICATIONS

This application is based upon and claims the benefit of priority from prior Japanese Patent Application No. 2004-282213, filed Sep. 28, 2004, the entire contents of which are incorporated herein by reference.

BACKGROUND OF THE INVENTION

1. Field of the Invention

The present invention relates to an apparatus (finisher) for bundling sheets sent from an image forming apparatus, thereby carrying out, for example, staple processing and a waiting tray for use in the post-process apparatus.

2. Description of the Related Art

A post-process apparatus comprises: a processing tray for bundling sheets sent from an image forming apparatus, thereby carrying out, for example, staple processing, and ejecting the processed bundles of sheets; and a storage tray for holding the ejected bundles of sheets. A staple processing speed of the post-process apparatus is slow as compared with an image processing speed of the image forming apparatus. Thus, if a sheet is directly sent to the processing tray, a sheet to be staple processed next is transported while a preceding sheet is staple processed. In order to prevent this problem, conventionally, a buffer mechanism for adjusting a carrying-in timing of a sheet at a front stage of the processing tray is proposed.

Japanese Patent Document 1: Japanese Patent No. 2583594 discloses a mechanism for retaining sheets is provided at a transport passage for sending sheets sent from an image forming apparatus to a processing tray. However, in this case, there is a need for increasing the transport passage in length, and, as a result, the post-process apparatus is likely to be large in size.

Japanese Patent Document 2: Jpn. Pat. Appln. KOKAI Publication No. 6-83132 discloses that a sheet transport device is provided at an upper portion of a tray member to transport a sheet by a sheet transport member via a number of actuating arm members. However, this mechanism does not relate to a waiting tray, and is technically different from that of the present invention. Therefore, advantageous effect of the present invention cannot be attained.

BRIEF SUMMARY OF THE INVENTION

The Inventors proposes here that a waiting tray is newly allocated as a buffer mechanism at an upper stage of a processing tray. The waiting tray according to this proposal is allocated to be proximal to the upper stage of the processing tray, and a sheet transported from an image forming apparatus to the processing tray is temporarily retained here in a waiting mode. At a time point when retention in a waiting mode is released, that is, at a time point when staple processing of a bundle of sheets at the processing tray terminates, and then, the bundle of sheets is transported from the processing tray to a storage tray, the sheet is supported on a bottom face of the waiting tray. By opening this tray, the sheet is then dropped at the distal end side (upstream side when the sheet is transported to the waiting tray) to the processing tray. By using this waiting tray, equipment can be allocated with a simple mechanism without a need to increase a transport passage in length and providing a space.

As a result, a post-process apparatus can be made compact. Moreover, it is possible to sent the sheets to the processing tray without any malfunction.

However, in addition to a sheet which is necessarily required to be staple processed, there is such a sheet that may be held on the storage tray as it is. With respect to such a sheet, there is a problem that the processing speed is decreased as the sheet is fed to the processing tray.

The present invention provides a sheet post-process apparatus for reliably dropping a sheet retained on a waiting tray in a waiting mode on a processing tray.

In order to solve the above described problem, the present invention comprises the following features.

1. A sheet post-process apparatus, the apparatus comprising:

a waiting tray which temporarily retains a transported sheet in a waiting mode, and releases the retention to drop the sheet;

a processing tray which bundles sheets dropped from the waiting tray to carry out predetermined processing, and ejects the sheets; and a storage tray which holds the bundle of sheets processed and ejected on the processing tray, wherein the waiting tray comprises:

a waiting tray roller which ejects a transported sheet on the storage tray;

first drive means for driving the waiting tray roller so as to come into contact with the sheet or so as to be spaced from the sheet; and second drive means for rotating the waiting tray roller in a direction in which the sheet is to be ejected, and the waiting tray roller is driven by the first and second drive means, making it possible to eject the sheet from the waiting tray directly to the storage tray.

2. A sheet post-process apparatus according to 1, comprising a control device of the first and second drive means, wherein, when a sense signal is inputted, the signal indicating that a sheet transported to the waiting tray is a sheet to be directly ejected to the storage tray, the control device drives the first drive means to move the waiting tray roller so that the roller comes into contact with the sheet, and drives the second drive means to rotate the waiting tray roller in a direction in which a sheet is to be ejected, and then, ejects the sheet on the storage tray.

3. A sheet post-process apparatus according to 1, wherein the waiting tray is allocated to be proximal to an upper stage of the processing tray, the processing tray and the waiting tray are allocated in an inclined shape which is high at a proximal end side of a sheet to be transported and which is low at a distal end side thereof, the processing tray and the waiting tray are shorter in length of a sheet transport direction thereof than a length of a standard sheet to be held, and a part of the proximal end side in the transport direction of the sheet held on the processing tray is held on the storage tray.

4. A waiting tray for use in a sheet post-process apparatus, for temporarily retaining a transported sheet in a waiting mode, followed by releasing the support, making it possible to drop the sheet on a processing tray, the waiting tray comprising:

a waiting tray roller which ejects a transported sheet on the storage tray;

first drive means for driving the waiting tray roller so as to come into contact with the sheet or so as to be spaced from the sheet; and second drive means for rotating the waiting tray roller in a direction in which the sheet is to be ejected, wherein the waiting tray roller is driven by the first and second drive means, making it possible to eject the sheet from the waiting tray directly to the storage tray.

In the present specification and claims, a proximal end side, a distal end side, and a sheet width are defined as follows. That is, when a transport direction of a sheet to be transported to a waiting tray is defined as a reference, a downstream side in the transport direction is defined as a proximal end side; an upstream side in the transport direction is defined as a distal end side; and a length in a transverse direction when the sheet transport direction is defined as a longitudinal direction is defined as a sheet width. In addition, a sheet denotes a copy sheet on which a toner image (developed image) is copied and which is sent from the image forming apparatus.

According to the present invention, a paper ejecting roller is provided on the proximal end side of the waiting tray, and it is sensed that a sheet to be transported to the waiting tray is a sheet which is not required to be retained on the waiting tray in a waiting mode (a sheet on which no processing is carried out on the processing tray or at the time of error), the roller is driven, thereby the transported sheet is directly ejected to the storage tray without intervening the processing tray. Accordingly, the processing speed can be increased.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Now, one embodiment of the present invention will be described here.

(General Description of Image Forming Apparatus)

Figure 18:
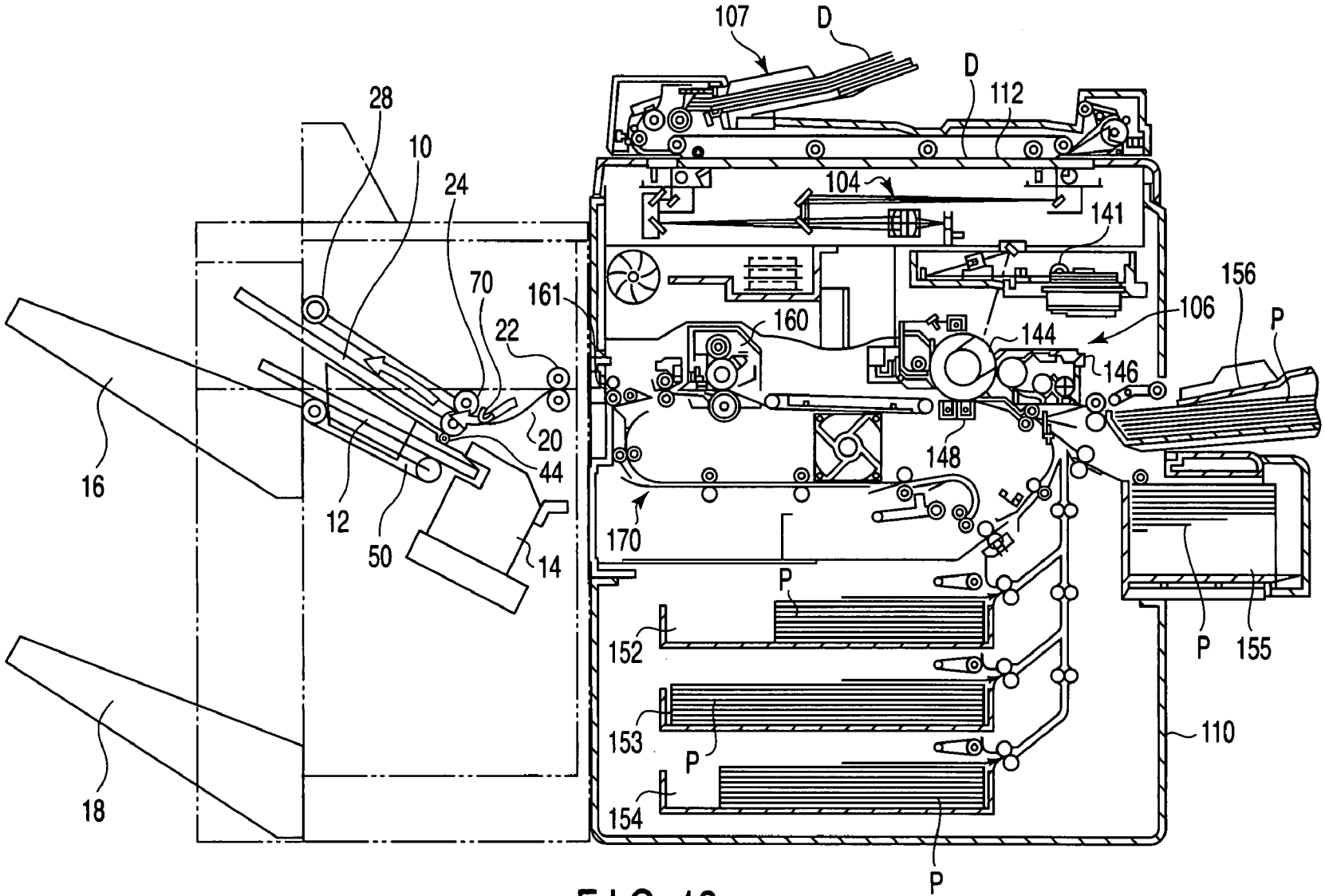
FIG. 18 is a view showing a combination of the post-process apparatus and the image forming apparatus according to the present invention.

A general description of an image forming apparatus (digital copying machine) allocated at a front stage of a post-process apparatus according to the present invention will be given with reference to FIG. 18. A manuscript placement base 112 is provided at an upper face of this apparatus. An auto document feeder 117 (hereinafter, referred to as an ADF) for automatically feeding a document D onto the manuscript placement base 112 is allocated on the manuscript placement base. The manuscript D is placed on the ADF, predetermined settings (such as the presence of absence of staple processing, how to carry out staple processing, the number of copies, or size of sheet to be copied, for example), and then, a copy start button is pressed. The manuscript D on the ADF is transported to a predetermined location of the manuscript placement base 112.

A scanner unit 4, a printer unit 6, and a copy sheet cassette and feeder are arranged at the inside of the image forming apparatus. At the scanner unit 4, the manuscript D on the manuscript placement base 112 is scanned, and reflection light thereof is incident. The incident reflection light is converted in a photoelectric manner, image information on the manuscript D is read, and a photoelectric signal corresponding to the read image information is output. At the printer unit 6, according to the image information or the like on the manuscript D read by the scanner unit 4, an electrostatic latent image is formed on a peripheral face of a photosensitive drum 144 by a semiconductor laser 141. Then, a toner is supplied from a developing device 146 to the photosensitive drum 144; the electrostatic latent image formed on the photosensitive drum 144 is substantially produced, and a tone image is formed.

To this photosensitive drum 144, a copy sheet P is sent from cassettes 52, 53, 54, and 56 or a feeder 55 of the copy sheet P, and the toner image on the photosensitive drum 144 is copied onto the copy sheet by a transfer charger 148. Then, the toner image of the copy sheet is fixed by a fixing device 160, and the fixed toner image is ejected from an ejection port 161. This sheet comes under the sheet of the present specification and claims.

In a control circuit of the image forming apparatus side, information concerning a sheet such as sheet size, the presence or absence of sort, or the presence or absence of staple processing is entered by operator's data input and/or an input signal from sensor means provided in the image forming apparatus. The control circuit at the image forming apparatus side sends information concerning a sheet transported to the control circuit of the post-process apparatus side based on these items of information. The information includes the following. For example, the sheet is provided as a sheet retained in the waiting tray in a waiting mode, the sheet being a sheet other than a last sheet to be held. The sheet is provided as a sheet retained in the standby sheet in a waiting mode, the sheet being a last sheet to be held. The sheet is provided as a sheet retained in the waiting tray in a waiting mode (a sheet being directly dropped on the processing sheet). The sheet is provided as a sheet being directly ejected to the storage tray without being dropped on the waiting tray. Information concerning dimensions of a sheet to be transported to the post-process apparatus (such as A3 or A4 size, for example) or sheet length (such as ordinary paper or a variety of cardboards, for example) is also sent from a control circuit at the image forming apparatus side to a control circuit at the post-process apparatus side.

Information concerning a length of a sheet which is larger than that of a set sheet is sensed by a sensor provided in the post-process apparatus. The sensed information is sent from this sensor to the control circuit at the post-process apparatus side.

(General Description of Post-Process Apparatus)

A general description of the post-process apparatus will be given with reference to FIG. 18. The post-process apparatus is provided as an apparatus for bundling sheets 20 transported from an image forming apparatus, thereby carrying out staple processing or the like. This post-process apparatus is allocated in contact with the ejection port 161 of the image forming apparatus. That is, a sheet transport inlet is provided in association with the ejection port 161 of the image forming apparatus, and an inlet roller 22 is allocated in this sheet transport inlet. The inlet roller 22 introduces the sheets 20 into a paper pass ceiling 36 for forming a transport passage in the post-process apparatus (refer to FIG. 1). This paper pass ceiling 36 guides a sheet to a waiting tray 10 and a processing tray 12. Two storage trays 16 and 18 are allocated at the downstream side of the processing tray 12 (at the downstream side of the waiting tray 10).

The waiting tray 10 is allocated to be proximal to the upper stage of the processing tray 12 while the waiting tray is inclined so as to be upward at the proximal end side of the sheet to be transported and so as to be downward at the distal end side. A paper feed roller 24 is provided at the distal end side of this waiting tray 10 (at the upstream side of the sheet to be transported), and a waiting tray roller 28 is provided at the proximal end side of the tray (at the downstream side of the sheet to be transported). A sheet sensor 70 is provided at the transport inlet of the paper feed roller 24. This sensor senses a proximal end and a distal end of the sheet to be transported.

The processing tray 12 is allocated at the lower stage of the processing tray 12 while the processing tray is inclined so as to be upward at the proximal end side of the sheet (at the downward side of the sheet to be transported to the storage tray) and so as to be downward at the distal end side (upstream side of the sheet to be transported to the ejected paper storage tray). A stapler 14 is provided at the distal end side of the processing tray 12. A transport mechanism 50 is provided on the processing tray 12 so as to transport a bundle of staple processed sheets or the like to the storage tray 16 or 18.

Here, in the post-process apparatus according to the present invention, the waiting tray 10 and the processing try 12 both are small in size, as compared with the size of sheet to be transported in order to make equipment compact. Since the waiting tray 12 is small in size than a sheet to be held thereon, when a sheet is dropped from the waiting tray 10 to the processing tray 12, that sheet is held across the processing tray 12 and the storage tray 16 (or 18) (refer to FIGS. 10 to 13).

A control circuit of the post-process apparatus controls the waiting tray 10 to make a proper operation based on information concerning a sheet obtained from the control circuit at the image forming apparatus side and information available from the sheet sensor 70.

For example, when a sheet transported to the waiting tray is provided as a sheet which should be retained on the waiting tray in a waiting mode, the sheet being a sheet other than a last sheet to be held, this sheet is kept to be held in a proper location of the waiting tray.

When the above sheet is provided as a sheet to be retained on the standby sheet in a waiting mode, the sheet being a last sheet to be held, that sheet is aligned in a proper location, and is dropped on the processing tray together with the sheet which has been held in advance on the waiting tray.

When the sheet is provided as a sheet which is not required to be retained on the waiting tray in a waiting mode, that sheet is directly dropped on the processing tray.

When the sheet is provided as a sheet to be directly ejected on the storage tray without being dropped on the processing tray, that sheet is directly transported from the waiting tray to the storage tray without intervening the processing tray.

When the sheet is provided as a sheet which is larger than a set sheet (for example, a sheet of A3 in size), the waiting tray is increased in length by expanding it.

<Waiting Tray>

Figure 1:
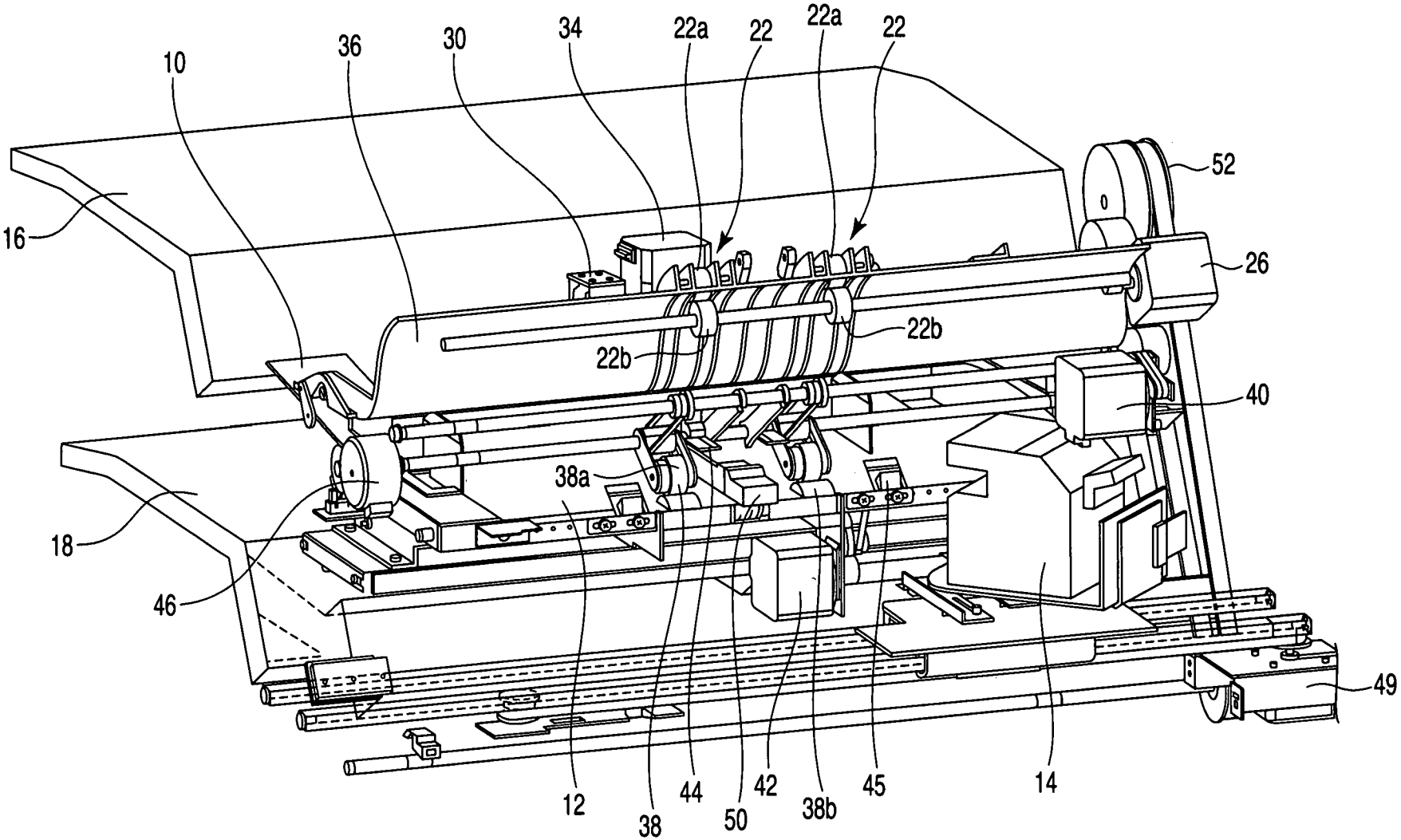
FIG. 1 is a perspective view of a post-process apparatus showing one embodiment of the present invention.
Figure 2:
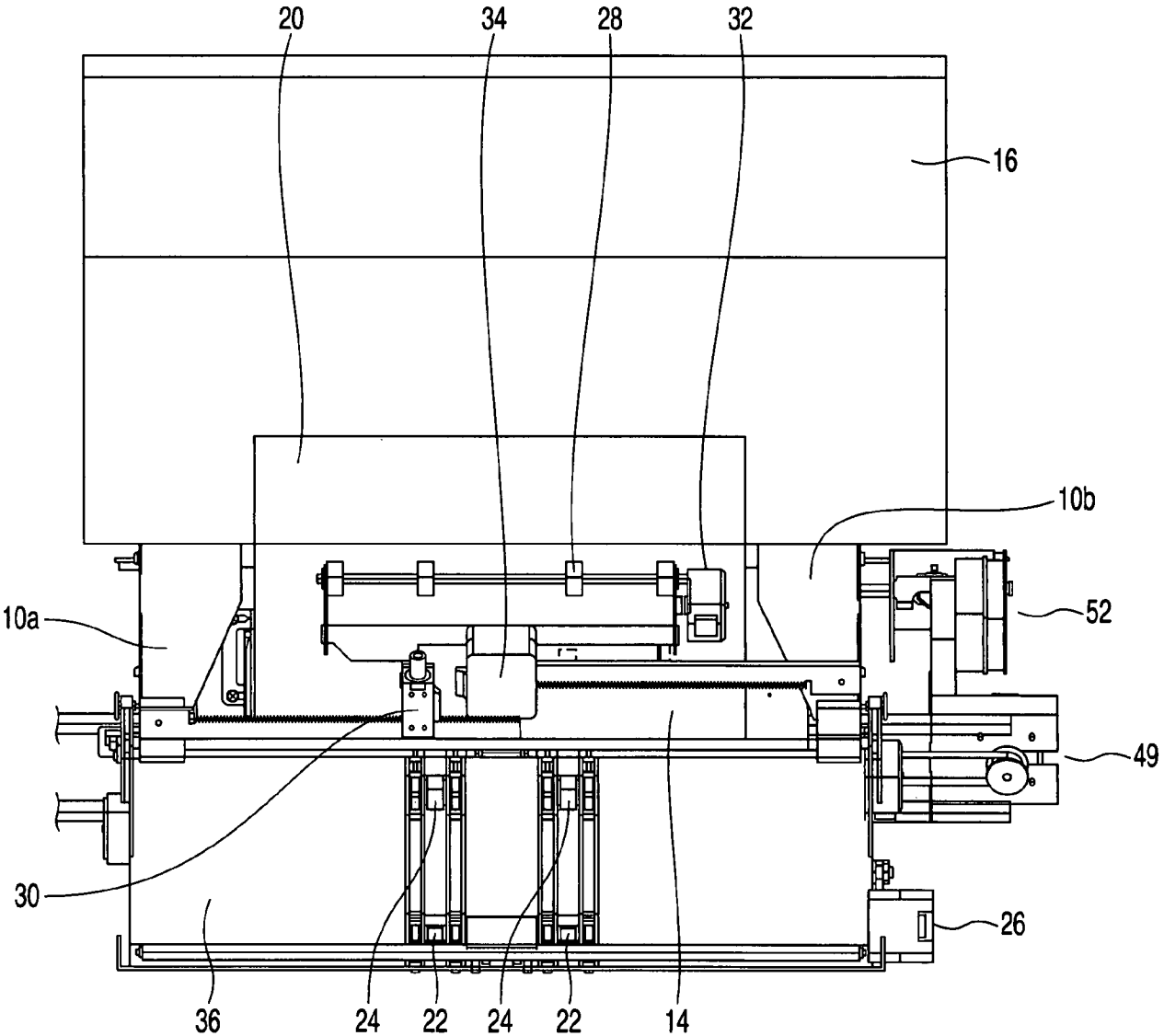
FIG. 2 is a top view of the post-process apparatus showing one embodiment of the invention.
Figure 3:
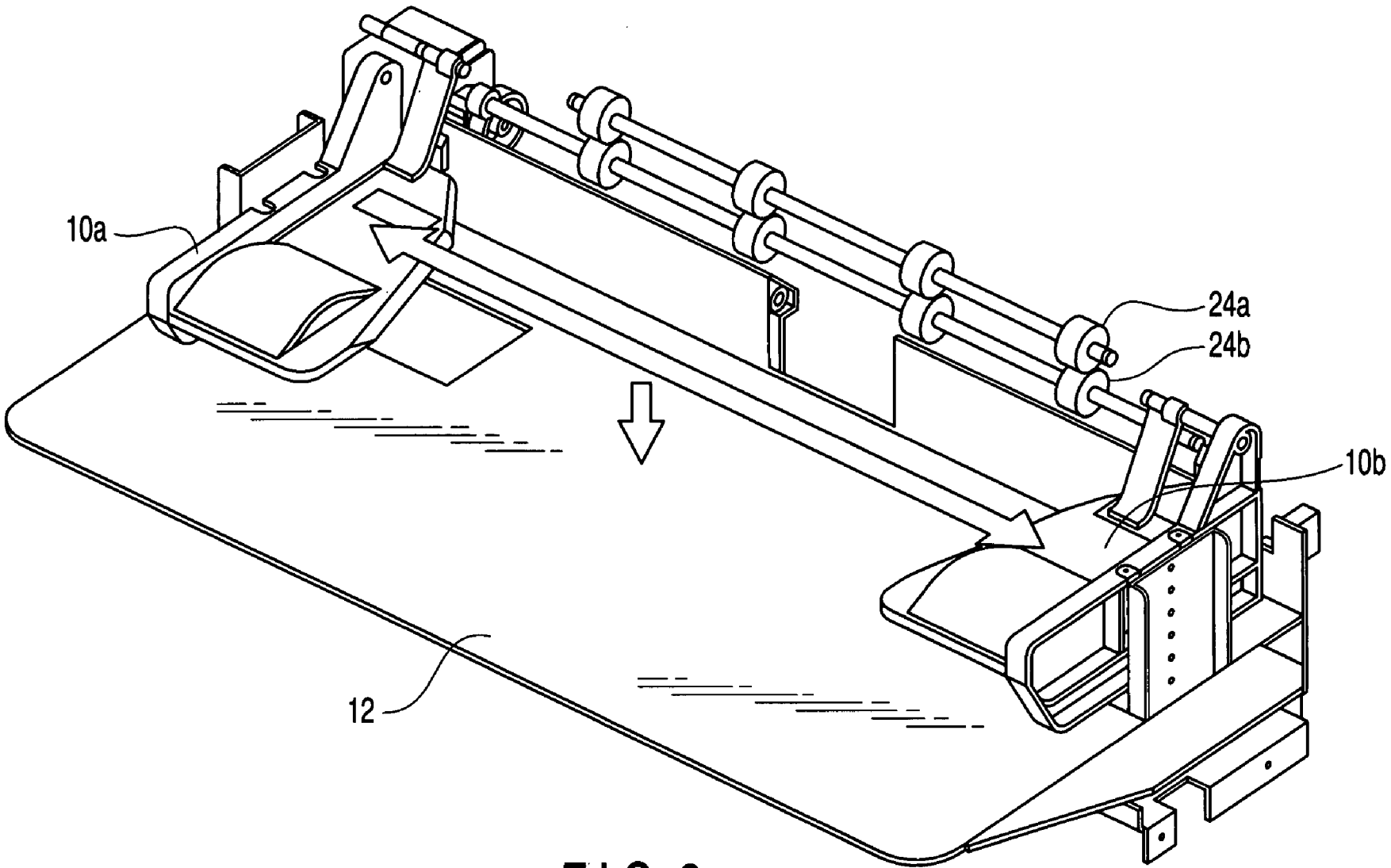
FIG. 3 is a view illustrating an operation of a waiting tray showing one embodiment of the invention.

The waiting tray will be described with reference to FIGS. 1, 2 and 3. As has been already described, when a preceding sheet is processed on the processing tray, a next sheet cannot be transported on the processing tray. The waiting tray is intended for make the next sheet standby in this state. The inlet roller 22 includes an upper inlet roller 22*a* and a lower inlet roller 22*b*. These rollers are driven by an inlet roller motor 26. The paper feed roller 24 includes an upper paper feed roller 24*a* and a lower paper feed roller 24*b*. These rollers are driven by a paper feed roller motor. The waiting tray roller 28 can be operated to be vertically elevated. This operation is controlled by a waiting tray roller drive source 30. The waiting tray roller 28 enables normal and invert rotation. This normal and invert rotation is carried out by a waiting tray roller motor 32.

On the waiting tray 10, left and right lower face support members 10*a* and 10*b* for supporting both sides of the lower face of a sheet carried into the waiting tray are provided in the left and right widthwise direction. A space between the left and right lower face support members is open. Therefore, a center section of the sheet lower face is not supported. The upper faces of these left and right lower face support members 10*a* and 10*b* each are formed in a flat shape, and a curved face which is upwardly curved is formed at its top end side. Instead of this curved face or together with the curved face, a roller which is rotatable in an arbitrary direction may be engaged. As shown in FIG. 2, the post-process apparatus comprises a waiting tray motor 34. A gear (pinion) is mounted on the waiting tray motor 34. This gear is meshed with a rack of the lower face support members 10*a* and 10*b*. Therefore, an open and close operation of the lower face support members 10*a* and 10*b* is made by driving the waiting tray motor 34. The left and right lower face support members 10*a* and 10*b* are formed to be wide in width at a proximal end side thereof and to be narrow in width at a distal end side thereof. As a result, the width of the opening portion formed between the lower face support members is wide at the proximal end side and narrow at the distal end side. The width used here denotes a transverse direction in the case where the sheet transport direction is defined as a longitudinal direction. The left and right lower face support members 10*a* and 10*b* are set in location in which a sheet side face can be supported fully on the left and right lower face support members at a first position. At a second position, these support members are set in location in which they are opened to an extent such that the proximal end side of the sheet is supported by the left and right lower face support members while the distal end side of the sheet is not supported by the left and right lower face support members. In addition, at a third position, the above support members are set in a location in which the support of the sheet is fully released. The left and right lower face support members 10*a* and 10*b* are driven by a waiting tray drive motor 34. By this waiting tray drive motor 34, the left and right lower face support members are moved to be slid to adjust the opening width of the opening portion. Then, the left and right lower face support members 10*a* and 10*b* are moved to any one of the first to third positions.

The waiting tray roller 28 returns the sheet transported to the waiting tray to the distal end side, and aligns the sheet distal end by abutting the sheet distal end against a distal end 60 of the waiting tray. In this case, although the sheets are located upwardly when they are transported to the waiting tray, the roller is lowered in the case where the sheet distal end is aligned. Then, the sheets are rotated while the sheets are compressed, and the sheets are pushed back.

In addition, in the case where the sheets are transported from the waiting tray directly to the storage tray, the waiting roller is lowered and is rotated while the sheets are compressed, and the sheets are ejected. In this case, the rotation direction of the waiting tray roller 28 becomes inverted from that in the case where the sheets are abutted against the distal end side.

On the waiting tray, there is provided the sheet sensor 70 (refer to FIGS. 19 and 20) for sensing a sheet to be proximal to the paper feed roller 24, i.e., at a side (upstream side) at which a sheet is carried in the waiting tray. This sheet sensor 70 senses the start of transport (sheet proximal end) by the paper feed roller 24 and the end of transport (sheet distal end) by the sheer feed roller 24. This sense signal is fed to control means (refer to FIG. 19).

The control means of the post-process apparatus having received information from the control means of the image processing apparatus (for example, the presence or absence of staple processing, how to carry out staple processing, the number of copies, and signal of size of sheet to be copied) senses whether the sheet to be transported to the waiting tray is provided as a sheet which should be retained on the waiting tray in a waiting mode or is provided as a sheet which is not required to be retained in a waiting mode. For example, the control means senses that the first and second sheets are provided as sheets to be retained on the waiting tray in a waiting mode and the third or subsequent sheets are provided as sheets which are not required to be retained in a waiting mode, based on information indicating how to carry out staple processing. Alternatively, the control means senses that retention in a waiting mode on the waiting tray is not required from the information indicating that no staple processing is carried out. In addition, the control means having received a signal from the sheet sensor 70 senses a state in which the sheet is carried into the waiting tray 10. Then, the control means of the post-process apparatus instructs the drive motor of the lower face support members 10*a* and 10*b* to output a control signal of a release timing or a release quantity (release width) of the left and right lower face support members 10*a* and 10*b*. Then, a sheet is properly dropped onto the processing tray 12 with a proper timing.

On the other hand, in the case where the sheet transported to the waiting tray is a sheet which is not required to be retained on the waiting tray in a waiting mode, when the sheet distal end reaches the waiting tray, the left and right lower face support members 10*a* and 10*b* are opened to be located at the second position immediately without the sheet being retained in a waiting mode. That is, the left and right lower face support members 10*a* and 10*b* are opened to an extent such that, although the proximal end side of the sheet is supported by the left and right lower face support members 10*a* and 10*b*, the distal end side of the sheet is not supported by the left and right lower face support members 10*a* and 10*b*. As a result, the release width of the above support members is merely released only at the distal end side, and thus, the sheet is dropped from the distal end side to the processing tray in a state in which it is supported at the proximal end side.

<Processing Tray>

The processing tray carries out longitudinal and transverse alignments with respect to bundles of sheets dropped from the waiting tray and carries out predetermined processing (for example, staple processing). This processing tray is allocated in an inclined shape which is high at its proximal end side and which is low in its distal end side.

Figure 4:
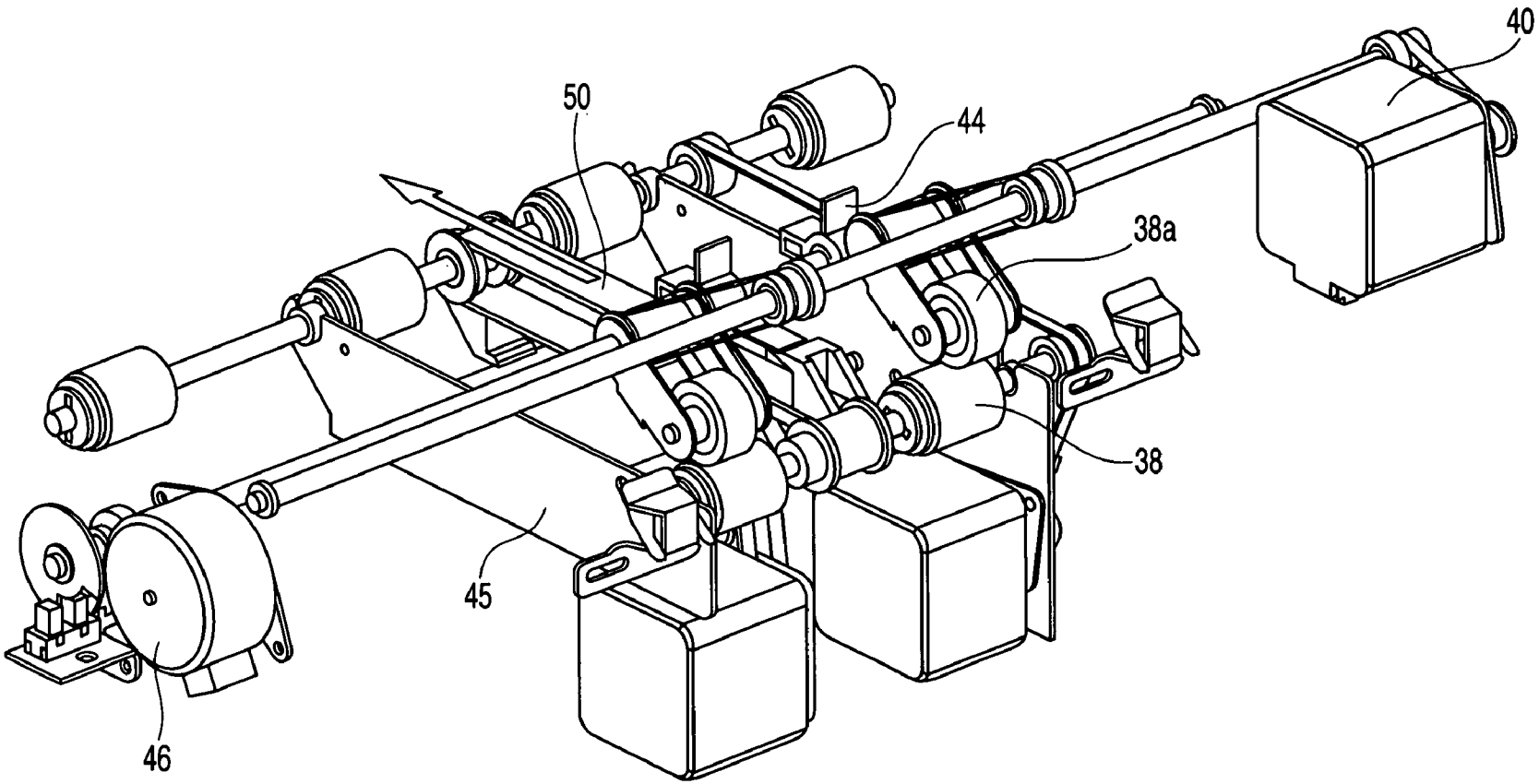
FIG. 4 is a view illustrating a longitudinal alignment and sheet bundle transport mechanism of the post-process apparatus showing one embodiment of the invention.

As shown in FIG. 4, longitudinal alignment is carried out by a longitudinal alignment roller 38. A longitudinal alignment upper roller 38*a* is driven by a longitudinal alignment upper roller motor 40, and a longitudinal alignment lower roller 38*b* is driven by a longitudinal alignment lower roller motor 42 to align sheets while a stopper 45 is defined as a reference. In addition, in order to assist this alignment, a paddle 44 is provided. This paddle 44 is driven by a paddle motor 46.

Figure 5:
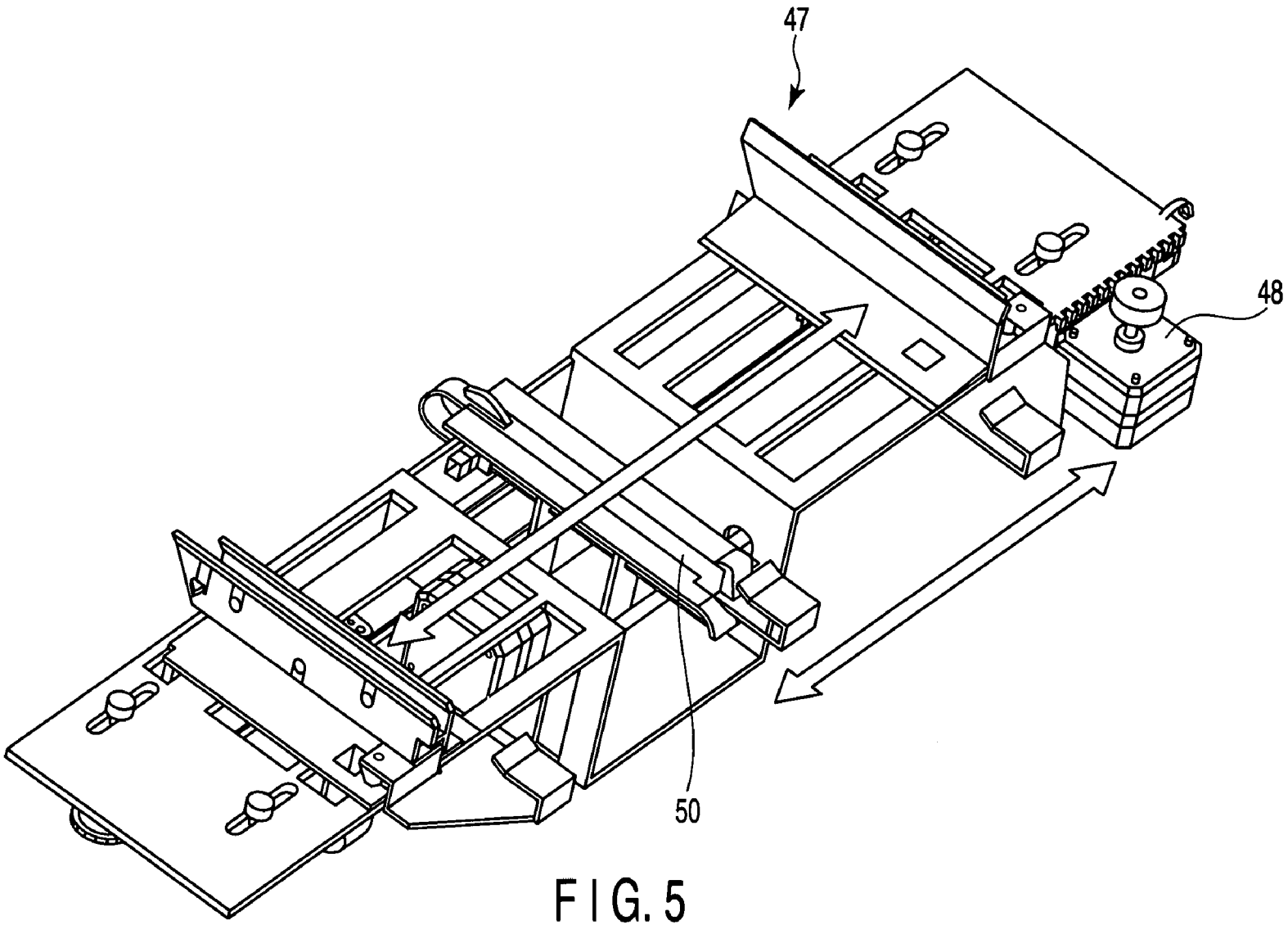
FIG. 5 is a view illustrating a transverse alignment mechanism of the post-process apparatus showing one embodiment of the invention.

As shown in FIG. 5, transverse alignment is executed by a transverse alignment mechanism 47 and a transverse alignment motor 48.

When a predetermined number of sheets are aligned and stacked on the processing tray 12, staple processing is carried out by the stapler 14.

Figure 6:
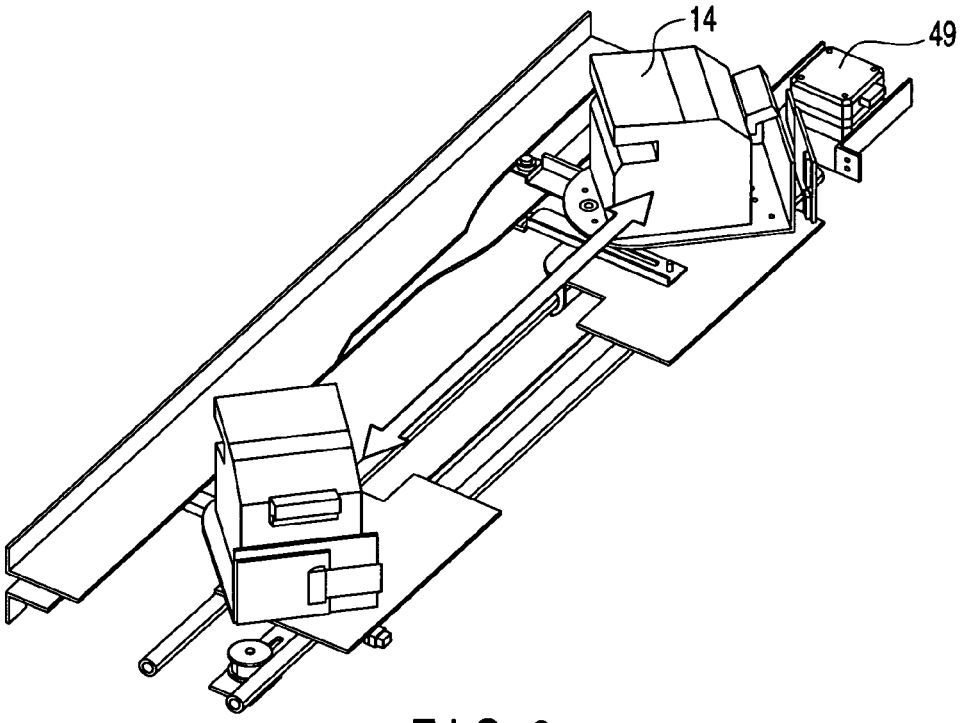
FIG. 6 is a view illustrating an operation of a stapler of the post-process apparatus showing one embodiment of the invention.
Figure 7:
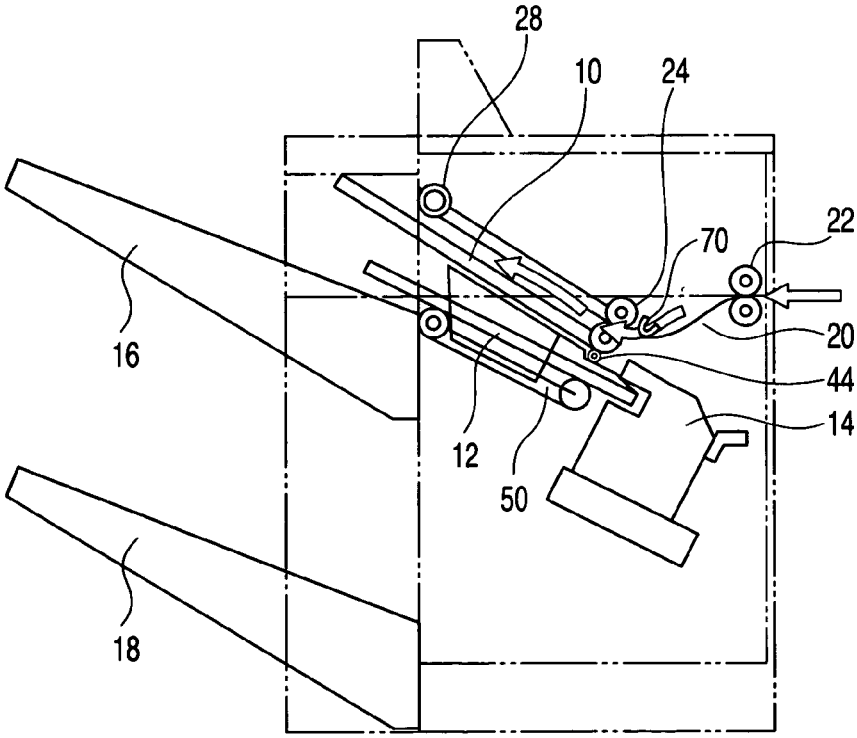
FIG. 7 is a view illustrating a flow of a first sheet of sheets between an inlet roller and a paper feed roller in the post-process apparatus showing one embodiment of the invention.
Figure 8:
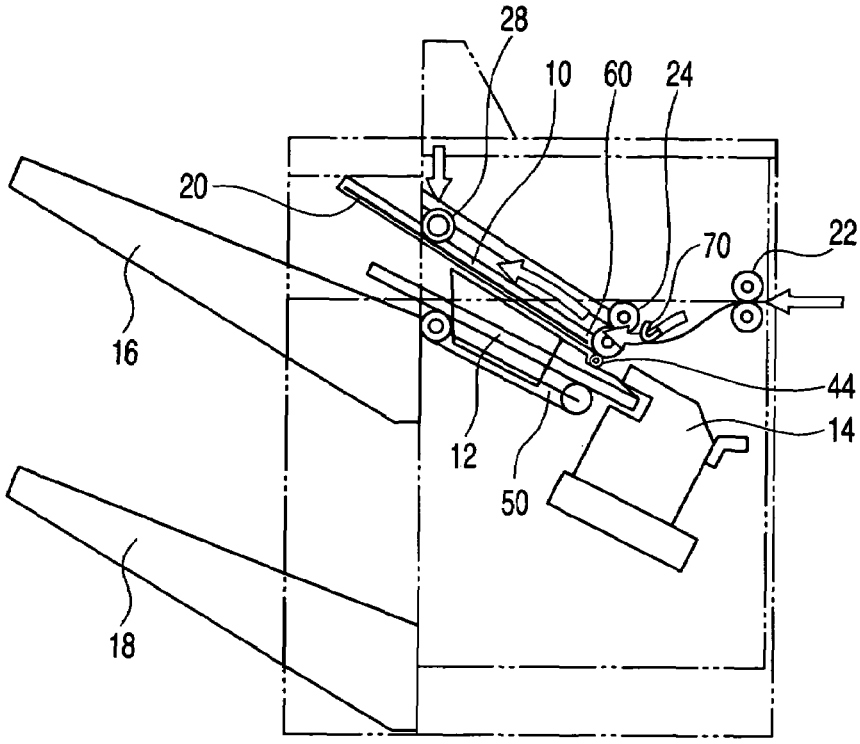
FIG. 8 is a view illustrating a flow of a first sheet of sheets between the paper feed roller and a standby roller in the post-process apparatus showing one embodiment of the invention.
Figure 9:
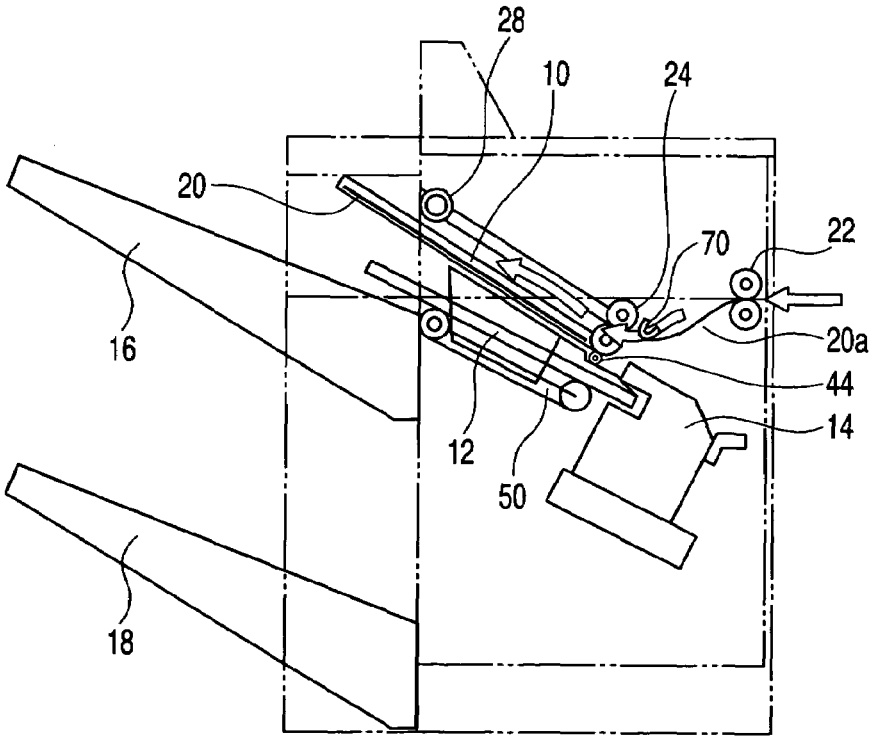
FIG. 9 is a view illustrating a flow of a second sheet of sheets between the paper feed roller and the standby roller in the post-process apparatus showing one embodiment of the invention.
Figure 10:
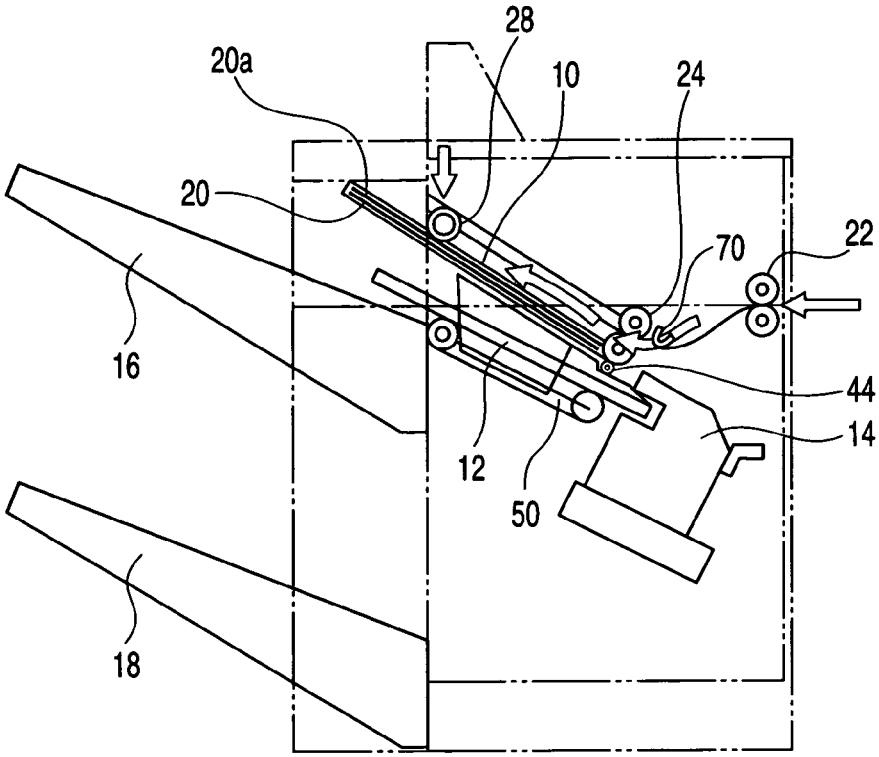
FIG. 10 is a view illustrating an operation of a waiting tray roller in the post-process apparatus showing one embodiment of the invention.

As shown in FIG. 6, the stapler 14 is positioned by a staple drive unit 49, and staple processing is controlled.

<Storage Tray>

As shown in FIG. 4, the staple processed bundles of sheets are sent to the storage tray 16 by the transport mechanism 50. Selection of the storage tray 16 or 18 is made by vertically moving the storage tray 16 or 18 by a storage tray drive unit 52.

In the case where sheets are directly ejected from the waiting tray 10, the storage tray is risen up to a location which corresponds to a sheet outlet of the waiting tray.

(Description of Operation)

Now, an operation of the post-process apparatus according to the present invention will be described with reference to FIGS. 7 to 18.

<Operation in Case where Staple Processing is Carried Out>

As has been already described, staple processing on the processing tray is slow as compared with that on the image processing apparatus. Thus, when a sheet transported from the image processing apparatus is processed on the processing tray, a buffer unit is provided at the front stage thereof. Then, it is necessary to make a next sheet not so as to be transported to the processing tray until the staple processing on the processing tray has completed. In this example, a description will be given with respect to a case in which two sheets (first and second sheets) are made standby on the waiting tray, and the third and subsequent sheets are not required to be made standby.

A first sheet from the image processing apparatus is transported to the waiting tray 10 via the inlet roller 22 and the paper feed roller 24. The sheet is retained by the left and right lower face support members 10*a* and 10*b* and the distal end support member which are set at the first position; the waiting tray roller 28 is lowered, and a sheet distal end is aligned (this alignment is made with the distal end 60 (upstream side) of the waiting tray 10).

Figure 11:
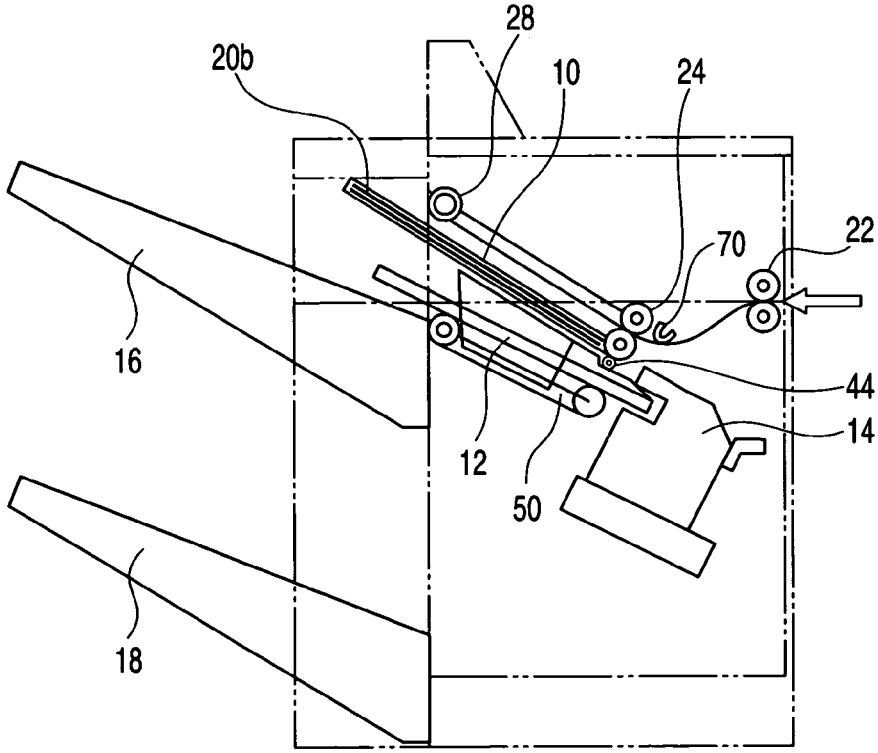
FIG. 11 is a view illustrating an operation of the waiting tray roller in the post-process apparatus showing one embodiment of the invention.
Figure 12:
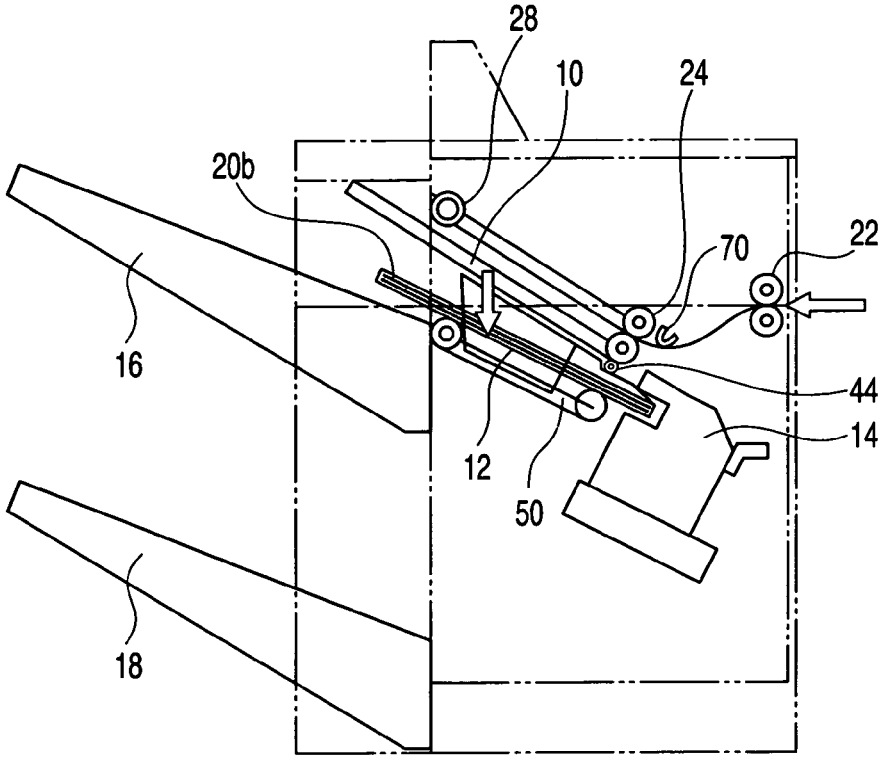
FIG. 12 is a view illustrating an operation of an active drop in the post-process apparatus showing one embodiment of the invention.

Next, the waiting tray roller 28 is risen, and is ready for accepting a second sheet 20*a*. When the second sheet 20*a* is sent to the waiting tray 10, the waiting tray roller 28 is lowered to align a location of the sheet with the distal end 60 of the waiting tray 10. Then, the waiting tray roller 28 is risen (FIG. 11). When the second sheet is transported to the waiting tray, the distal end portion of the sheet is sensed by the sheet sensor 70. Based on this sense signal, the first and second sheets are dropped onto the processing tray 12 altogether. That is, the left and right lower face support members 10*a* and 10*b* are released to be located at the second position so as to release support of both sides of the sheet.

Then, with respect to the third and subsequent sheets, it is possible to transport these sheets from the paper feed roller 24 directly to the waiting tray while the waiting tray is kept in a state in which the support of the sheets is released. However, in the present invention, the above sheets are dropped to the processing tray 12 via the waiting tray 10. With respect to this matter, a description will be given with reference to FIGS. 21 to 24.

After a second sheet has been dropped on the processing tray, as shown in FIG. 21, the left and right lower face support members 10*a* and 10*b* return to the first position, and are kept in a state in which the third sheet can be supported. In this state, the third sheet is transported to the waiting tray 10 (FIG. 22). In a transport state, an opening operation (operation for widening an opening portion) of the left and right lower face support members 10*a* and 10*b* is started (FIG. 23). Then, when the sheet sensor 70 senses that the sheet distal end portion has been transported to the waiting tray 10, the waiting tray is released to the second position at this time point. At the second position, although the proximal end side (downstream side) of the left and right lower face support members 10*a* and 10*b* is retained, the distal end side (upstream side) thereof is released. Therefore, the sheet is reliably dropped from the distal end side to the processing tray. In this manner, the sheet is dropped on the processing tray without being retained on the waiting tray 10 in a waiting mode, so that a processing speed can be increased. Moreover, on the processing tray 12, the sheet is dropped from the distal end side so that the sheet can be stably dropped with good posture. Therefore, alignment processing of the sheet distal end on the processing tray 12 can be easily carried out. Moreover, the waiting tray 10 is allocated to be inclined lowly at the distal end side. This allocation helps the sheet being reliably dropped on the processing tray.

Figure 13:
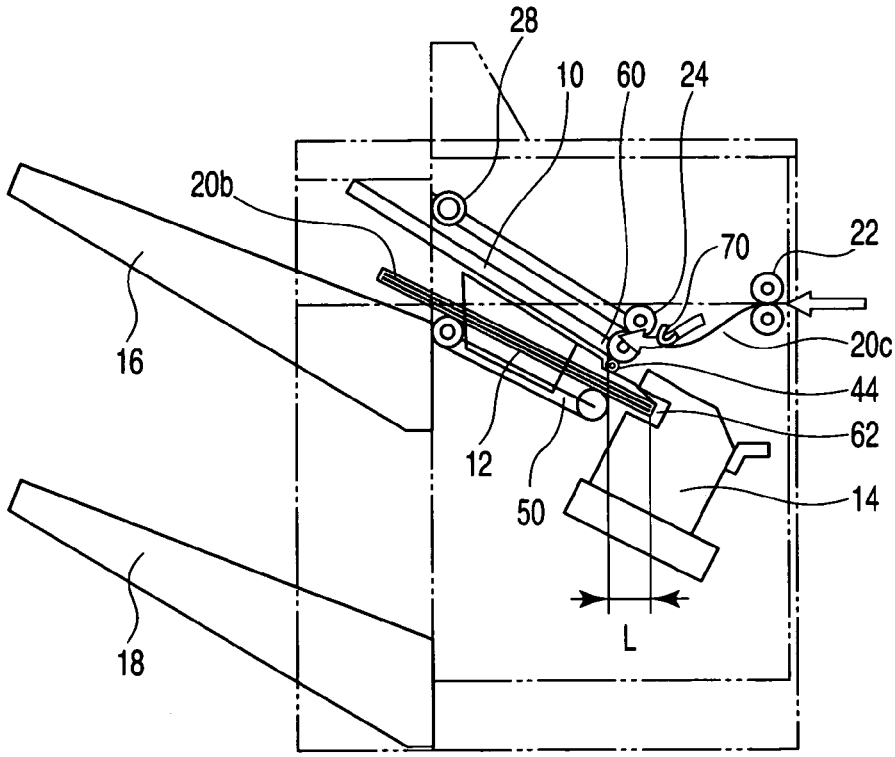
FIG. 13 is a view illustrating a flow of a third sheet of sheets in the post-process apparatus showing one embodiment of the invention.

Now, turning to FIG. 13, a state in which the second sheet has been held on the processing tray 12 will be described here. On the processing tray 12, a predetermined number of sheet bundles 21 are formed to be stacked on two bundles of sheets 20*b*. At this time, the longitudinal and transverse alignment mechanisms 38 and 47 function, and longitudinal and transverse sheet alignments are executed. At this time, as shown in FIG. 13, the distal end 60 of the waiting tray 10 and a distal end (upstream side) 62 of the processing tray 12 are spaced from each other in a transverse direction with a distance L so that the distal end 60 of the waiting tray 10 exists on the downstream side more than the distal end 62 of the processing tray 12. With such a construction, the bundles 20*b* of sheets are easily dropped from the waiting tray 10 to the processing tray 12, and an aligning operation by the longitudinal and transverse alignment mechanisms 38 and 47 can be easily made. As a result, an occurrence of jamming can be prevented.

The processing tray 12 is allocated to be obliquely inclined together with the waiting tray 10. Thus, the respective distal ends 60 and 62 are located at the lowest position, and the sheets 20 and the bundles of sheets 21 can be aligned with the distal ends 60 and 62 by its own weight of the sheets 20 and the bundles of sheets 21.

Figure 14:
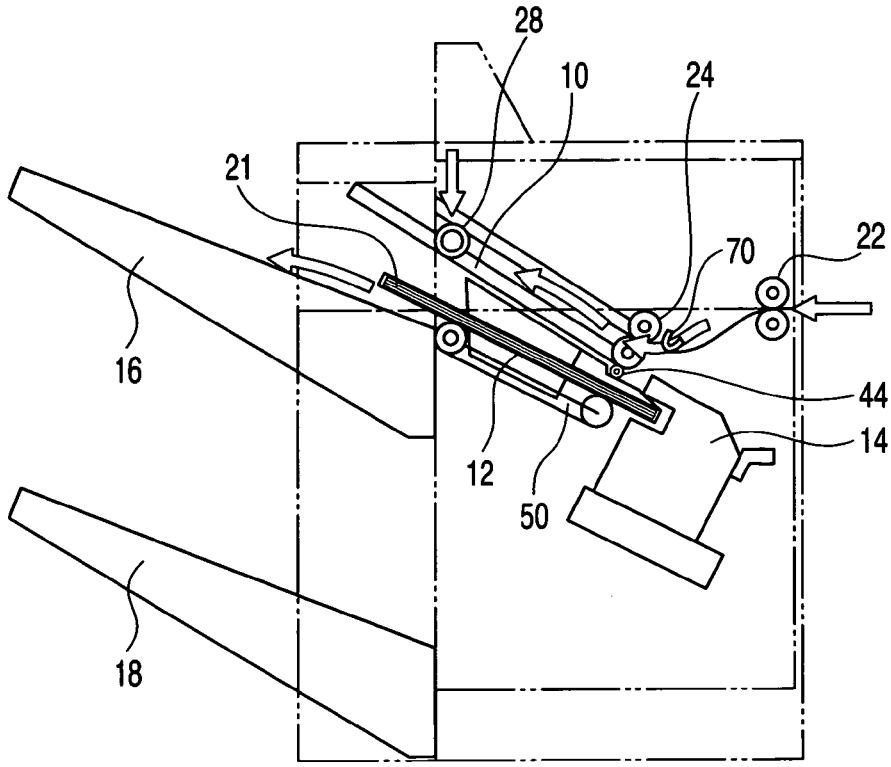
FIG. 14 is a view illustrating an operation of a stapler in the post-process apparatus showing one embodiment of the invention.
Figure 15:
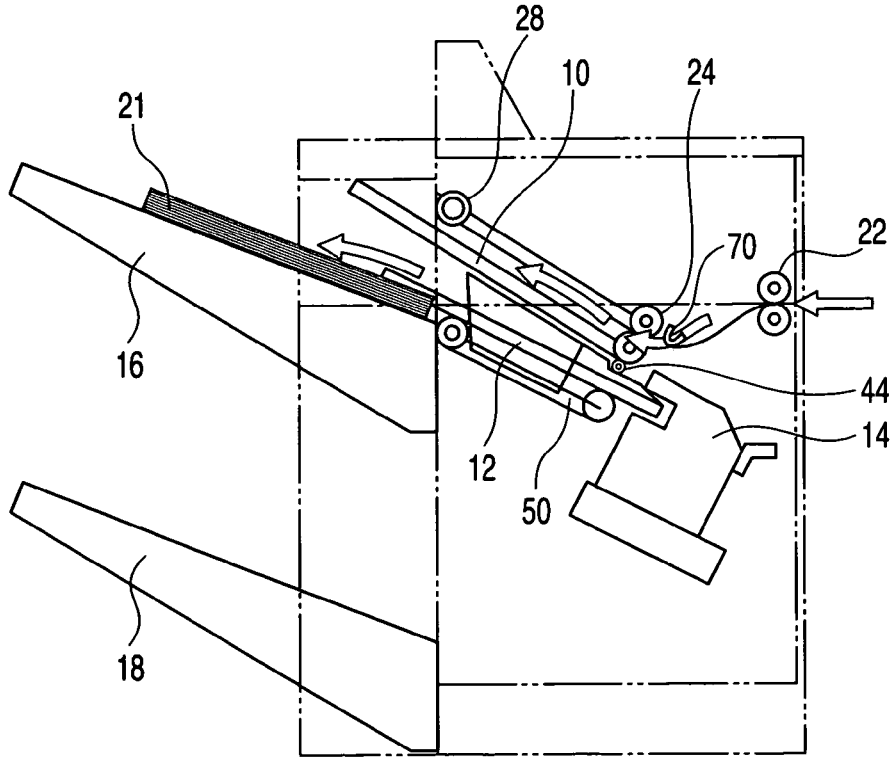
FIG. 15 is a view illustrating a flow of a bundle of sheets between a processing tray and a storage tray in the post-process apparatus showing one embodiment of the invention.

Next, as shown in FIG. 14, the bundles of sheets 21 are staple processed by the stapler 14. Then, as shown in FIG. 15, the bundles of sheets 20 are fed to the storage tray 16 by the transport mechanism 50, and post-process terminates.

<Operation in Case where No Post-Process is Required>

Figure 16:
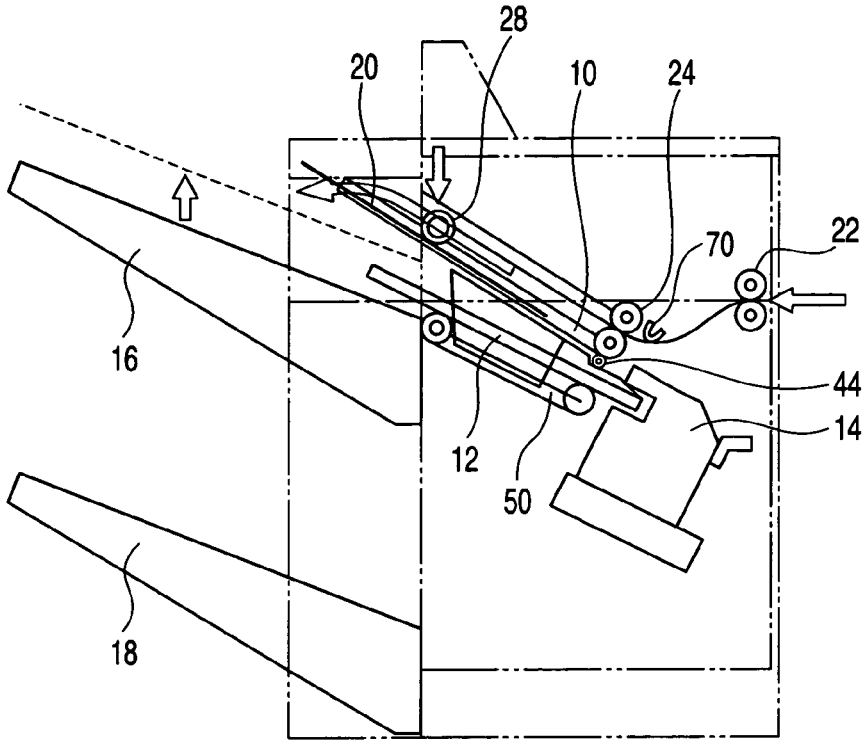
FIG. 16 is a view illustrating a flow of direct sheet ejection of a sheet from the waiting tray to the storage tray in the post-process apparatus showing one embodiment of the invention.
Figure 17:
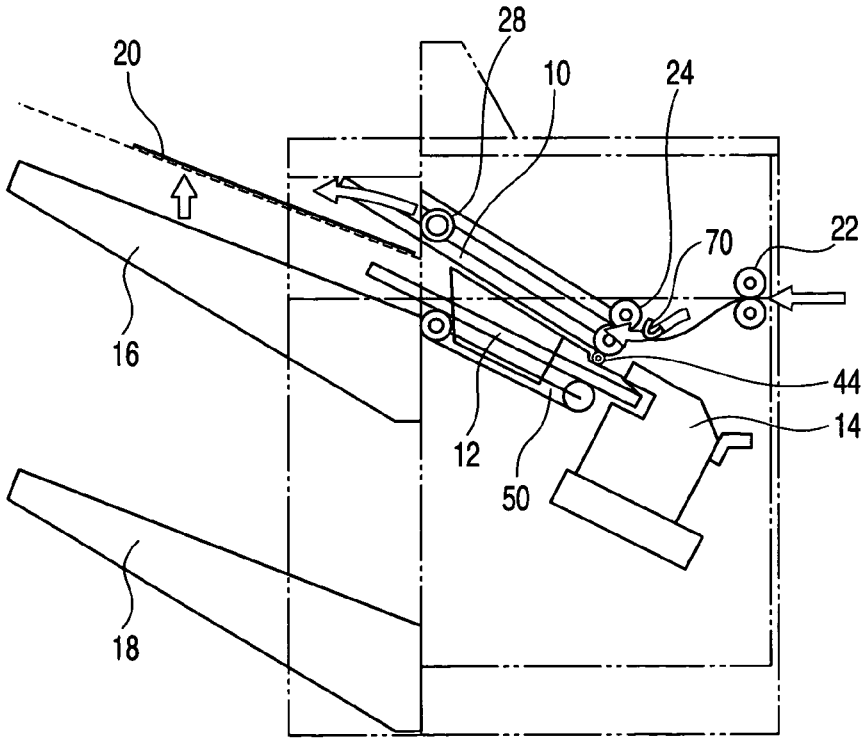
FIG. 17 is a view illustrating an operation of a position change of the storage tray in the post-process apparatus showing one embodiment of the invention.

In the case where no post-process (such as a case in which non-sort or non-staple processing is carried out or a case in which jamming occurs) is required, as shown in FIGS. 16 and 17, the sheets are ejected from the waiting tray 10 directly to the storage tray 16 without intervening the processing tray 12. Information indicating whether or not a sheet to be ejected is a sheet which does not require post-process is obtained from a control circuit of the image processing apparatus. As shown in FIG. 16, the sheets fed from the image processing apparatus are fed to the storage tray 16 via the paper feed roller 24 or the waiting tray 10. That is, above the proximal end side of the waiting tray 10, the waiting tray roller 28 is arranged in association with locations of the left and right lower face support members. The control means of the post-process apparatus receives information concerning a sheet to be transported from the control means of the image forming apparatus, and senses that the sheet transported to the waiting tray is a sheet to be directly held on the storage tray without being processed on the processing tray. Based on this sense signal, the control means of the post-process apparatus drives the waiting tray roller drive source 30, and locates the waiting tray roller on an upper face of a tray to which the sheet can be transported. Then, the waiting tray roller 28 is driven by a waiting tray motor 34. Then, the sheets held on the waiting tray are held directly on the storage tray without being held on the waiting tray. In this case, the storage tray is slightly risen by the storage tray drive portion 52 to receive the sheets fed from the waiting tray 10. In addition, the sheets held on the waiting tray may be held directly on the storage tray without being held on the waiting tray.

In the case where a roller is engaged with the distal at the proximal end side of the left and right lower face support members, even if the roller and the paper ejecting roller come into contact with each other anytime, the sheets are smoothly transported to the waiting tray. This makes it possible to provide a structure for maintaining the paper ejecting roller to be in contact with the roller anytime (a structure in which no elevating operation is made). In this case, it is necessary to provide a waiting tray roller drive source for operating the waiting tray roller to be elevated.

Although embodiments of the present invention have been described above, the present invention is not limited to the embodiments. Constituent elements shown in the embodiments can be changed to other constituent elements as long as they have the same functions.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A sheet post-process apparatus, the apparatus comprising:

a waiting tray which temporarily retains a transported sheet in a waiting mode, and releases a retention to drop the sheet;

a processing tray which bundles sheets dropped from the waiting tray to carry out predetermined processing, and ejects the bundle of sheets; and a storage tray which holds the bundle of sheets processed and ejected on the processing tray, wherein the waiting tray comprises:

a waiting tray roller which ejects a transported sheet on the storage tray;

first drive means for driving the waiting tray roller so as to come into contact with the sheet or so as to be spaced from the sheet; and second drive means for rotating the waiting tray roller in a direction in which the sheet is to be ejected, and the waiting tray roller is driven by the first and second drive means, making it possible to eject the sheet from the waiting tray directly to the storage tray.

2. A sheet post-process apparatus according to claim 1, comprising a control device of the first and second drive means, wherein, when a sense signal is inputted, the signal indicating that a sheet transported to the waiting tray is a sheet to be directly ejected to the storage tray, the control device drives the first drive means to move the waiting tray roller so that the roller comes into contact with the sheet, and drives the second drive means to rotate the waiting tray roller in a direction in which a sheet is to be ejected, and then, ejects the sheet on the storage tray.

3. A sheet post-process apparatus according to claim 1, wherein the waiting tray is allocated to be proximal to an upper stage of the processing tray, the processing tray and the waiting tray are inclined, each with shape a proximal end side of a sheet located at a lower level, the processing tray and the waiting tray are shorter in length of a sheet transport direction thereof than a length of a standard sheet to be held, and a part of the proximal end side in the transport direction of the sheet held on the processing tray is held on the storage tray.

4. A waiting tray for use in a sheet post-process apparatus, for temporarily retaining a transported sheet in a waiting mode, followed by releasing a support, making it possible to drop the sheet on a processing tray, the waiting tray comprising:

a waiting tray roller which ejects a transported sheet on a storage tray;

first drive means for driving the waiting tray roller so as to come into contact with the sheet or so as to be spaced from the sheet; and second drive means for rotating the waiting tray roller in a direction in which the sheet is to be ejected, wherein the waiting tray roller is driven by the first and second drive means, making it possible to eject the sheet from the waiting tray directly to the storage tray.

* * * * *